United States Patent [19]

Schlachter

[11] 4,009,552

[45] Mar. 1, 1977

[54] DEVICE FOR PACKAGING OF GOODS

[75] Inventor: Kurt Schlachter, Wallau, Lahn, Germany

[73] Assignee: Kramer & Grebe GmbH & Co. KG Maschinen-und Modellfabrik, Wallau, Lahn, Germany

[22] Filed: June 23, 1975

[21] Appl. No.: 589,701

[30] Foreign Application Priority Data

June 25, 1974 Germany ..... 2430497

[52] U.S. Cl. ..... 53/86; 53/112 R

[51] Int. Cl.[2] ..... B65B 31/02

[58] Field of Search ..... 53/79, 86, 112 R, 112 A, 53/11

[56] References Cited

UNITED STATES PATENTS

| | | | |
|---|---|---|---|
| 2,780,043 | 2/1957 | Hensgen | 53/86 |
| 3,832,828 | 9/1974 | Martin | 53/112 A |

*Primary Examiner*—Travis S. McGehee

*Attorney, Agent, or Firm*—Woodhams, Blanchard and Flynn

[57] ABSTRACT

A packaging device for forming a package having upper and lower sheets closed by the upper sheet being weldably secured to the lower sheet. The lower sheet is formed into a container for holding various types of material. The packaging device has an evacuating chamber having two chamber halves relatively movable with respect to each other. A nozzle bar is mounted on one of the chamber halves and is movable therewith toward and away from the other chamber half. A passageway is provided between the nozzle bar and the corresponding chamber half on which it is mounted and is adapted to receive the upper sheet therethrough. The lower sheet formed into a container is moved through a passageway between the two chamber halves when the chamber halves have been moved apart. A seal is provided around the nozzle bar and between the chamber halves to permit an evacuation of the evacuating chamber when the chamber halves are in mating engagement with each other.

9 Claims, 7 Drawing Figures

DEVICE FOR PACKAGING OF GOODS

FIELD OF THE INVENTION

The invention relates to a packaging device for a package which is to be closed by an upper sheet having a frame-like constructed welding device having a separate drive therefor to weld together two sheet strips, of which at least one is in the form of a container and having an evacuating chamber formed of two chamber-like halves, of which one half is mounted for movement up and down below the sheets, the other half being above the mentioned sheets with one of the halves receiving the framelike welding device therein.

BACKGROUND OF THE INVENTION

Prior to the upper sheet being welded together with the lower sheet, the package or the evacuating chamber receiving the package is evacuated so that the goods are not yet quite cooking at the packaging temperature. For example, goods which are suited for being deep-frozen are packaged in a hot condition. A packaging temperature of above 80° C. is best because a sterilization of the goods is achieved at the same time. Further, a packaging of the goods is accomplished in such a manner that the space which remains within the package above the goods is without air. This is necessary because the oxygen contained in the air would oxidize the air and, because of the air entrapped in the package, would expand in a water bath during the usual warming up of the sealed package and would possibly burst the package.

For evacuating the air from the package it is known to close the package in an evacuating chamber.

However, the vacuum in the evacuating chamber cannot be chosen of any low degree, as already mentioned. The achievable vacuum depends on the type of the goods which must be packaged and on the temperature at which the goods are packaged. Thus, a residue of air remains in the package. To remove the air which remains in the package, it is known to blow into the evacuating chamber or directly into the package a steam or a gas and to subsequently close the package by putting the upper sheet and the lower sheet together.

In order to remove the air from the package through the vacuum chamber, either the upper sheet is made more narrow than the lower sheet, so that the latter cannot be gripped by the two sides of the upper chamber half, or the lower and/or upper sheets have perforations therein.

The steam which is blown into the package removes the air from said package. After the assembly, for example by welding the upper sheet and lower part of the package together, there will be exclusively a steam or a gas in the free space above the goods. During venting of the evacuating chamber and after cooling off of the goods, the steam condenses, so that an air-empty space is created above the goods. Since the entire vacuum chamber including the package must be filled with gas or steam, a high usage of gas is the result.

The basis purpose of the invention is to construct the packaging device described above in such a manner that the evacuation and blowing in of steam into the package can be carried out substantially quicker than with the known devices and the packaging device is less expensive to manufacture.

This purpose is attained inventively by a packaging device, which is characterized by at least one half of the evacuating chamber having on at least one side of its edge engaging the opposite half a recess, into which recess is snugly received a nozzle bar which is connected to a steam supply line. This inventive device permits a considerable savings in gas, because only the package itself needs to be filled with gas. According to a preferred embodiment of the invention one nozzle bar each is mounted on two oppositely positioned sides of the evacuating chamber.

Through this arrangement one obtains a quick and thorough flushing of the package, in particular if the package is evacuated by a nozzle bar which is connected to an evacuating pipe, while steam is blown into the package through the other nozzle bar.

The nozzle bar of the invention can be mounted on each side of the packaging device with the exception of the sheet outlet side. If the nozzle bar is mounted on the sheet inlet side, then it is possible if the upper sheet is narrower than the upper half of the evacuating chamber, to evacuate the package through the upper half of the evacuating chamber, while through the nozzle bar exclusively steam is blown into the package. If an upper sheet is used, which is wider than the evacuating chamber, then the package must be evacuated through the nozzle bar and must subsequently be steamed or gassed.

In an arrangement of the nozzle bar in the area of the sheet edges, the upper sheet is arranged at this point so that it is engaged by the frame of the upper half of the evacuating chamber. The nozzle bar grips then between the upper sheet and the lower sheet, so that the steam can be introduced directly into the package. If the upper sheet is also engaged on the other side by the upper half of the frame of the evacuating chamber, then the evacuation of the package is done also through the nozzle bar. Also in the case of an evacuation of the package through the nozzle bar, both halves of the evacuating chamber are evacuated, because otherwise the sheets of the package are pressed together prior to the welding through the air pressure resting on them and thus, for example, liquid goods can escape. On the other hand, evacuation of the package itself would be more difficult.

According to a further embodiment of the invention, the nozzle bar is resiliently suspended so that during a driving together of the upper and lower chamber halves a tight seal between the nozzle bar and the two chamber halves is obtained. At least in the upper half of the evacuating chamber there are arranged in the area of the nozzle bar sealing elements. These sealing elements in connection with the resilient support of the nozzle bar effect an absolutely tight seal of the evacuating chamber and of upper and lower sheets of the package from the outside air.

BRIEF DESCRIPTION OF THE DRAWINGS

Several exemplary embodiments of the invention will be described more in detail hereinafter in connection with the drawings, in which.

DETAILED DESCRIPTION

Figure 2:
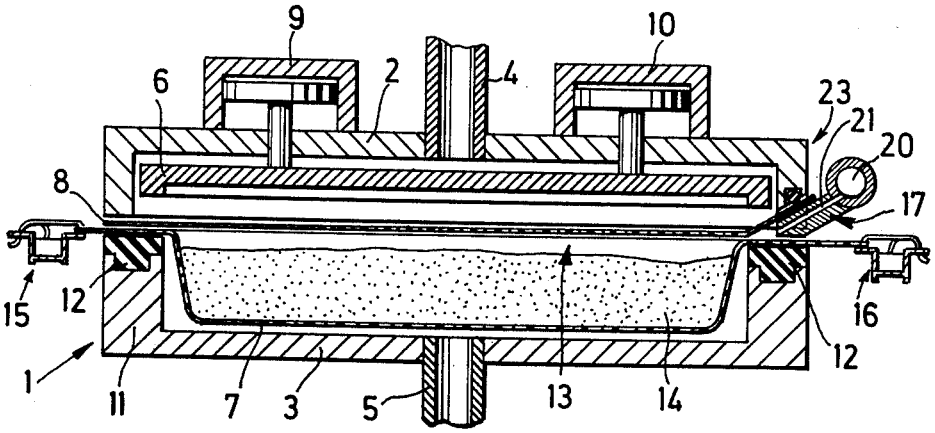
FIG. 2 is a cross-sectional view along the line II—II of FIG. 1.
Figure 1:
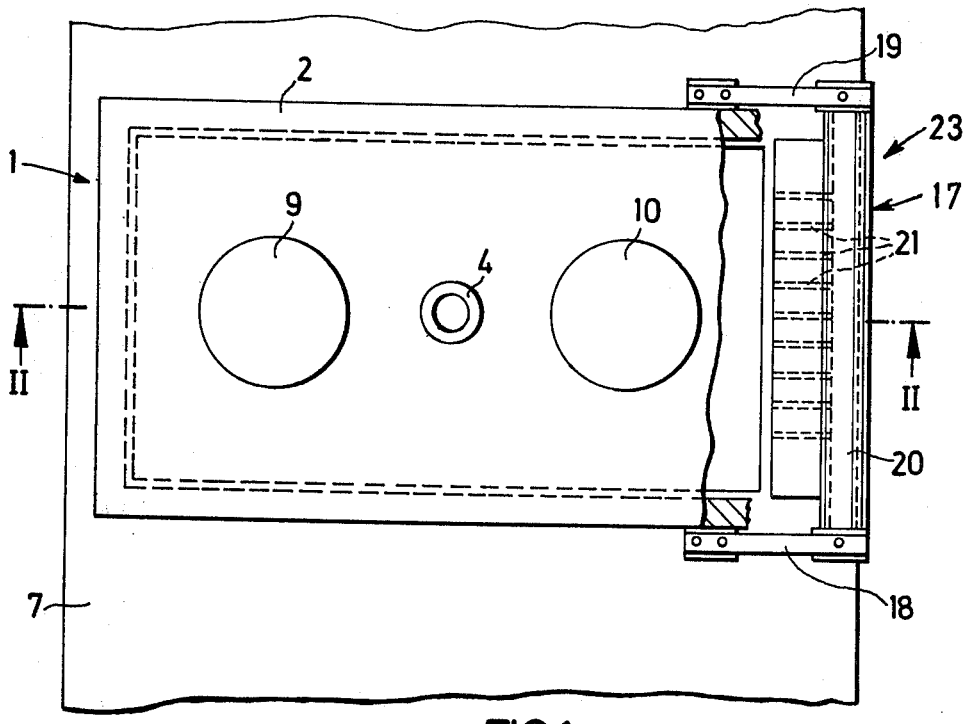
FIG. 1 is a top view of an inventive packaging machine.

In FIGS. 1 and 2, the evacuating chamber of the packaging machine is identified as a whole by reference numeral 1. The evacuating chamber 1 is composed of two seperate chamberlike halves 2, 3 (referred to collectively by the reference numeral 23), which are both constructed to be movable relative to one another. A vacuum pipe 4 is connected to the upper chamber half 2 and a vacuum pipe 5 is connected to the lower chamber half 3. In the upper half 2 of the evacuating chamber 1 there exists a welding frame 6, which is used to weld together a lower sheet 7 to an upper sheet 8 to form the package. The welding frame 6 is arranged for movement up and down within the chamber half 2 by means of lifting cylinders 9, 10 mounted on the chamber half 2. In the face of the peripheral edge 11 of the lower half 3 of the evacuating chamber there is mounted a sealing strip 12. The sealing strip 12 assures during a moving together of the two chamber halves 23 a tight sealing engagement therebetween.

Figure 3:
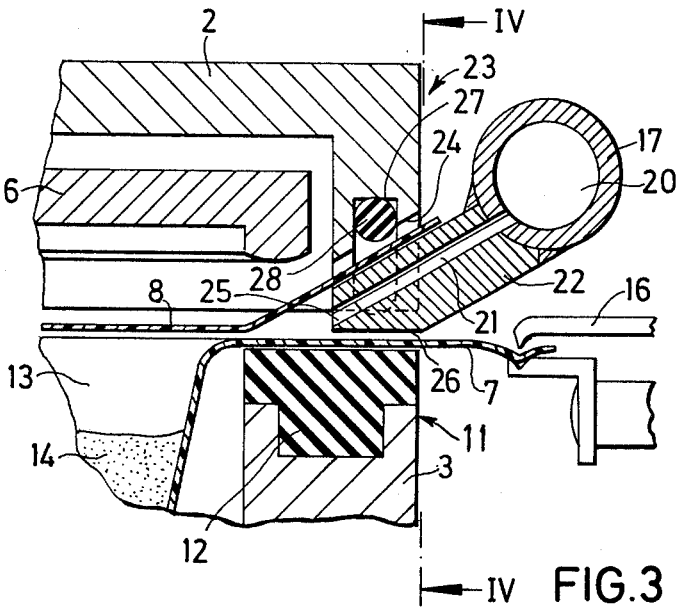
FIGS. 3 and 4 illustrate in an enlarged scale a nozzle bar according to the exemplary embodiment of FIG. 1.

The package formed by a lower sheet 7 and an upper sheet 8 is identified as a whole by the reference numeral 13. The lower sheet 7 is formed into a container to receive the goods 14 therein. The package 13 is closed with the upper sheet 8 within the evacuating chamber after completing an evacuation and a steaming of the package 13. After an evacuation of the package 13 and the upper and lower chamber halves 23, the lower sheet 7 and the upper sheet 8 are welded together by the welding frame 6 which is moved vertically into engagement with the peripheral edges thereof. The lower sheet 7 is transported by endless clamp chains 15, 16 through the spacing between the chamber halves 23 when they are separated as illustrated in FIG. 3. The clamp chains are arranged on both sides of the lower sheet and grip said sheets at their longitudinal edges.

A nozzle bar 17 is used for the steaming and possibly for the evacuation of the package 13. The nozzle bar 17 engages laterally the evacuating chamber 1. The nozzle bar 17 has leaf springs 18, 19 secured thereto at the ends thereof, which in turn are mounted on the chamber half 2. Through this resilient support of the nozzle bar 17 it is assured that, one the one hand, during a moving together of the two chamber halves 23, the edges of the two chamber havles tightly engage the nozzle bar 17 and that, on the other hand, when the chamber halves are spaced apart, the nozzle bar is spaced a distance from both edges of the chamber halves. This is necessary so that the sheets, which are located between the chamber halves and nozzle bar, can be transported without damage occurring thereto.

The nozzle bar 17 has a central supply channel 20, from which extend several laterally extending bores 21 located in a bar-shaped part 22 and which extend inside of the evacuating chamber 23.

Figure 4:
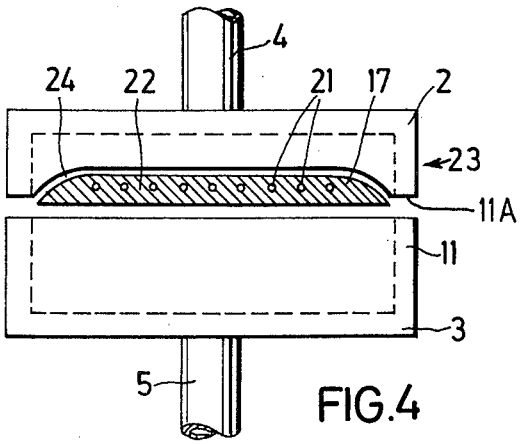

FIGS. 3 and 4 illustrate the nozzle bar 17 in an enlarged scale. The same corresponding parts have the same reference numerals applied thereto. The nozzle bar 17 extends with its bar-shaped part 22 into a recess 24 formed in the edge 23 of the upper chamber half 2 so that the outwardly opening openings 25 of the bores 21 open outwardly inside of the evacuating chamber 1 when the chamber halves 2, 3 are closed. A passageway is provided between the nozzle bar 17 and a wall of the recess 24 to facilitate the passage of the sheet 8 therethrough as shown in FIGS. 1 and 3. The lower end 26 of the nozzle bar 17 is sloped and engages the upper surface of the sheet 7 to press the under surface of the sheet 7 into tight engagement with the sealing strip 12. A sealing member 28 is arranged in a groove 27 in the recess 24, which sealing member effects a tight seal of the evacuating chamber 1 with respect to the bar-shaped part 22 of the nozzle bar 17 when the chamber halves 2, 3 are closed.

In an arrangement of the nozzle bar 17 on the longitudinal sides of the sheet strips, as is illustrated in FIGS. 1 to 4, the nozzle bar must be shorter than the length of the evacuating chamber, so that the edges 11 and 11A (FIG. 4) of the two chamber halves engage one another and thus assure a tight sealing engagement of the evacuating chamber.

Figure 5:
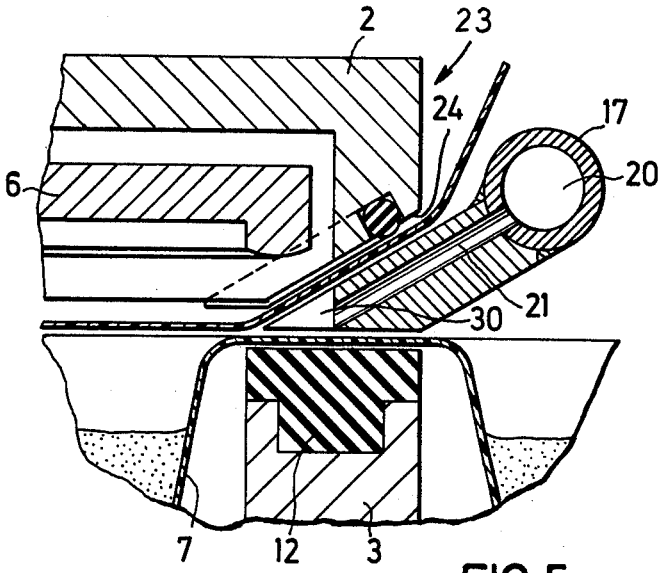
FIG. 5 is a cross-sectional view of a further exemplary embodiment of a nozzle bar according to the invention.
Figure 7:
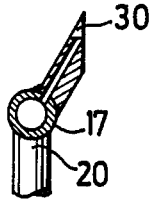
FIG. 7 is a cross-sectional view along the line VII—VII of FIG. 6.
Figure 6:
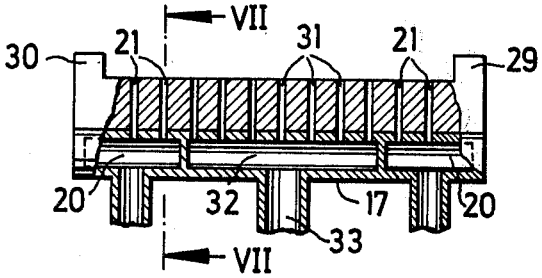
FIG. 6 is a front view of a nozzle bar according to FIG. 5, for example in cross section.

A modified nozzle bar 17A is illustrated in FIGS. 5 to 7. The modified nozzle bar 17A is used in the situation where the nozzle bar 17A is mounted on the sheet inlet. The nozzle bar 17A has the same length as the chamber and the recess 24 in the upper chamber half 2 extends over the entire width of the chamber half. Wedge-shaped shoulders 29, 30, which are formed on the nozzle bar 17A, are used to seal off the edges of the chamber, and the shoulders are formed corresponding to the shape of the recess 24. Otherwise, the structure of the nozzle bar is the same as described in FIGS. 1 to 4.

The nozzle bars shown in FIG. 6 have, aside from the bores 21 for the admission of steam, also bores 31 for the evacuation of the vacuum package 13. The bores 31 terminate in a channel 32, which is connected to a vacuum pipe 33.

The vacuum package 13 needs to be evacuated through the nozzle bar 17A always when the width of the upper sheet is greater or at least equal to the width of the vacuum chamber 1. In this case, the edges 11, 11A press the lower sheet 7 and upper sheet 8 strongly against one another. An evacuation of the package 13 through the chamber halves 2 and 3 is then no longer possible. In this case, it is advantageous to use a nozzle arrangement according to FIG. 6, through which the package 13, can be both evacuated and also steamed. It is also conceivable to use the same bores 21 for the steaming and evacuation, in this case, the gas or steam pipe and the vacuum pipe must be connected interchangeably with the bores 21. This may be done for example by the use of a two-way valve.

A vacuum must be produced in the two chamber halves 2, 3 of the evacuating chamber 1 also when the evacuation of the package 13 is done through the nozzle bar 17. If a vacuum would not be produced in the chambers 2, 3 during the evacuation of the package 13 through the nozzle strip, then the sheets 7 and 8 would be moved against one another by the air pressure lying on same, so that the goods in the package 13 could be pressed out of it. Consequently a perfect welding together of upper sheet 7 and lower sheet 8 by means of the welding frame 6 is no longer possible.

The edge 11 of the lower chamber half 3 is chosen so wide that it is used as an abutment during welding for the welding frame 6. When a nozzle bar is used according to FIG. 6, welding takes place between the shoulders 29 and 30.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or priviledge is claimed are defined as follows:

1. In a packaging apparatus having first means for providing a first package member defining a material-receiving cavity, second means for providing a second package member, said first and second package members being in overlying relation to each other and third means for effecting a sealing of said first package member to said second package member, the improvement comprising:

evacuation chamber means comprising first and second chamber halves supported for movement away from each other to an opened position and toward and into sealing engagement with each other and a closed position;

nozzle means mounted on at least one side of said evacuation chamber means and to one of said first and second chamber halves;

means defining a spacing between said first and second chamber halves when in said opened position for receiving one of said first and second package members therebetween and into said evacuation chamber means;

passageway means between said nozzle means and said one of said first and second chamber halves for receiving the other of said first and second package members therein and into said evacuation chamber means; and sealing means in said passageway means for effecting a sealing engagement of said other of said first and second package members to said one of said first and second chamber means and said nozzle means in response to a sealing engagement between said first and second chamber halves with each other in said closed position.

2. The improvement according to claim 1, wherein said nozzle means includes a nozzle and support means for supporting said nozzle for movement relative to said one of said first and second chamber halves.

3. The improvement according to claim 2, wherein said support means includes resilient means for resiliently supporting said nozzle on said one of said first and second chamber halves.

4. The improvement according to claim 3, wherein said resilient means includes at least a pair of spaced and parallel leaf springs connected to and extending between said nozzle and said one of said first and second chamber halves.

5. The improvement according to claim 1, wherein the edges of one of said first and second chamber halves are wider than are the edges of the other of said first and second chamber halves leaving a remainder portion on said edges when said first and second chamber halves are in sealing engagement with each other; and wherein said third means is mounted in one of said first and second chamber halves and is adapted to engage and clamp the edges of said first and second package members between said third means and said remainder portion.

6. The improvement according to claim 1, including a connection for connecting a vacuum source to said nozzle means for evacuating said evacuation chamber means.

7. The improvement according to claim 6, including a further connection for connecting a sorce of pressurized steam to said nozzle means.

8. The improvement according to claim 7, wherein said nozzle means includes means for separating said vacuum source connection from said source of pressurized steam connection.

9. The improvement according to claim 1, wherein said one of said first and second chamber halves has an edge with means defining a recess therein which opens outwardly toward said other of said first and second chamber halves whereby upon a closing of said first and second chamber halves on wall of said recess means will be defined by said other of said first and second chamber halves; and wherein said nozzle means is mounted in said recess means.

* * * * *

UNITED STATES PATENT AND TRADEMARK OFFICE

CERTIFICATE OF CORRECTION

PATENT NO. : 4 009 552

DATED : March 1, 1977

INVENTOR(S) : Kurt Schlachter

It is certified that error appears in the above-identified patent and that said Letters Patent are hereby corrected as shown below:

Please correct the spelling of the name of the Assignee to include the umlaut. "Kramer" should be ---Krämer---.

Signed and Sealed this

Third Day of May 1977

[SEAL]

*Attest:*

RUTH C. MASON
*Attesting Officer*

C. MARSHALL DANN
*Commissioner of Patents and Trademarks*